US009222039B2

(12) United States Patent
Surma et al.

(10) Patent No.: US 9,222,039 B2
(45) Date of Patent: Dec. 29, 2015

(54) GRATE FOR HIGH TEMPERATURE GASIFICATION SYSTEMS

(75) Inventors: Jeffrey E. Surma, Richland, WA (US); James A. Batdorf, Kennewick, WA (US)

(73) Assignee: INENTEC INC., Bend, OR (US)

( * ) Notice: Subject to any disclaimer, the term of this patent is extended or adjusted under 35 U.S.C. 154(b) by 1011 days.

(21) Appl. No.: 13/316,571

(22) Filed: Dec. 12, 2011

(65) Prior Publication Data

US 2013/0145691 A1 Jun. 13, 2013

Related U.S. Application Data

(63) Continuation of application No. 12/008,956, filed on Jan. 14, 2008, now Pat. No. 8,118,891.

(51) Int. Cl.

| | |
|---|---|
| ***C10J 3/40*** | (2006.01) |
| ***F23H 9/08*** | (2006.01) |
| ***F23H 13/08*** | (2006.01) |
| ***F23G 5/00*** | (2006.01) |
| ***F23G 5/027*** | (2006.01) |

(52) U.S. Cl.

CPC . *C10J 3/40* (2013.01); *F23G 5/002* (2013.01); *F23G 5/0276* (2013.01); *F23H 9/08* (2013.01); *F23H 13/08* (2013.01); *C10J 2300/0946* (2013.01); *C10J 2300/1634* (2013.01)

(58) Field of Classification Search

CPC ..... C10J 3/40; F23H 9/08; F23G 5/0276

See application file for complete search history.

(56) References Cited

U.S. PATENT DOCUMENTS

| | | | | |
|---|---|---|---|---|
| 1,560,304 | A | 11/1925 | Pardee | |
| 3,166,258 | A * | 1/1965 | Turner, Jr. | B02C 1/04 241/218 |
| 3,841,239 | A | 10/1974 | Nakamura et al. | |
| 3,889,889 | A | 6/1975 | Sawa | |
| 4,498,909 | A | 2/1985 | Milner et al. | |

(Continued)

FOREIGN PATENT DOCUMENTS

| | | | |
|---|---|---|---|
| GB | 2116201 | A | 9/1983 |
| WO | WO 01/05910 | A1 | 1/2001 |
| WO | WO 01/53434 | A1 | 7/2001 |

OTHER PUBLICATIONS

Office Action dated Oct. 19, 2012 from Canadian Patent Application No. 2,651,920.

(Continued)

*Primary Examiner* — Matthew Merkling

(74) *Attorney, Agent, or Firm* — Dorsey & Whitney LLP

(57) ABSTRACT

An improved active grate consisting of at least two elongated rockers positioned parallel to one and another, each rocker having a lower surface and an upper surface and configured to rotate back and forth about their longitudinal axis. Each individual rocker is further configured to rotate in the opposite direction of the adjacent rockers such that any pair of adjacent rockers alternately forms a void allowing material to pass through active grate when rotating in one direction into a first position, and closes the void when rotated in the opposite direction in a second position. The active grate finds particular utility in a combined gasification/vitrification waste treatment system, where it is used to pass partially oxidized materials from a gasification chamber to a vitrification chamber. The rockers include a coolant loop through the longitudinal axis of the rockers.

9 Claims, 4 Drawing Sheets

(56) References Cited

U.S. PATENT DOCUMENTS

| | | | | |
|---|---|---|---|---|
| 4,611,332 | A | 9/1986 | Santen | |
| 4,631,384 | A | 12/1986 | Cornu | |
| 4,831,944 | A | 5/1989 | Durand et al. | |
| 4,874,587 | A | 10/1989 | Galloway | |
| 4,886,001 | A | 12/1989 | Chang et al. | |
| 5,034,021 | A * | 7/1991 | Richardson | C10G 1/002 201/34 |
| 5,078,327 | A * | 1/1992 | Kemetter | B02C 1/00 241/102 |
| 5,107,517 | A | 4/1992 | Lauren et al. | |
| 5,666,891 | A | 9/1997 | Titus et al. | |
| 5,756,957 | A | 5/1998 | Titus et al. | |
| 5,798,497 | A | 8/1998 | Titus et al. | |
| 5,811,752 | A | 9/1998 | Titus et al. | |
| 5,847,353 | A | 12/1998 | Titus et al. | |
| 5,958,264 | A | 9/1999 | Tsantrizos et al. | |
| 6,037,560 | A | 3/2000 | Titus et al. | |
| 6,066,825 | A | 5/2000 | Titus et al. | |
| 6,199,778 | B1 | 3/2001 | Hanvey, Jr. | |
| 6,987,792 | B2 | 1/2006 | Do et al. | |
| 7,854,775 | B2 | 12/2010 | Surma et al. | |
| 8,118,891 | B2 | 2/2012 | Surma et al. | |
| 8,118,892 | B2 | 2/2012 | Surma et al. | |
| 2002/0069798 | A1 | 6/2002 | Aguadas Ellis | |
| 2002/0159929 | A1 | 10/2002 | Kaneko et al. | |
| 2004/0159366 | A1 * | 8/2004 | Tsangaris et al. | F23G 5/027 141/59 |
| 2004/0245086 | A1 | 12/2004 | Steynberg et al. | |
| 2005/0116075 | A1 * | 6/2005 | Bosch | B02C 18/142 241/236 |
| 2005/0166810 | A1 | 8/2005 | Gnedenko et al. | |
| 2006/0075945 | A1 | 4/2006 | Batdorf | |
| 2007/0001045 | A1 * | 1/2007 | Aizenberg | B02C 4/08 241/236 |
| 2007/0006528 | A1 * | 1/2007 | Diebold | B01D 29/27 48/197 R |
| 2007/0029421 | A1 | 2/2007 | Potts | |
| 2007/0261303 | A1 | 11/2007 | Surma et al. | |
| 2008/0104887 | A1 | 5/2008 | Tsangaris et al. | |
| 2008/0222956 | A1 * | 9/2008 | Tsangaris | C10J 3/005 48/77 |
| 2009/0000190 | A1 | 1/2009 | Surma et al. | |
| 2009/0020637 | A1 | 1/2009 | Raaz et al. | |
| 2009/0178337 | A1 | 7/2009 | Surma et al. | |
| 2011/0056133 | A1 | 3/2011 | Surma et al. | |
| 2012/0061618 | A1 * | 3/2012 | Santoianni | C04B 28/04 252/373 |
| 2012/0090237 | A1 | 4/2012 | Surma et al. | |

OTHER PUBLICATIONS

Office Action dated Jun. 25, 2012 for Japanese Patent Application No. 2009-509535.

Office Action mailed Feb. 7, 2012 for Japanese Patent Application No. 2009-509535, Feb. 3, 2012, 1-4.

Office Action dated Jan. 25, 2012 for European Patent Application No. 06 774 325.2, Jan. 25, 2012, 5.

"International Search Report and Written Opinion, International Application PCT/US2006/025512 dated Apr. 4, 2008".

Antal, Jr., Michael J. , "Synthesis gas production from organic wastes by pyrolysis/steam reforming", Energy from Biomass and Wastes Symposium, symposium papers presented Aug. 14-19, Washington, DC, Institute of Gas Technology, Chicago, 495.

Kaske, G. et al., "Hydrogen production by the Huls plasma-reforming process", Advanced Hydrogen Energy, vol. 5 (1986.

* cited by examiner

GRATE FOR HIGH TEMPERATURE GASIFICATION SYSTEMS

CROSS REFERENCE TO RELATED APPLICATIONS

This application is a continuation of U.S. application Ser. No. 12/008,956 filed on Jan. 14, 2008 for GRATE FOR HIGH TEMPERATURE GASIFICATION SYSTEMS, now U.S. Pat. No. 8,118,891, issued Feb. 21, 2012.

TECHNICAL FIELD

The present invention relates generally to a methods and apparatus for processing feedstocks containing organic materials. More specifically, the present invention relates to a grate particularly suited to use in partial oxidation gasification systems. The present invention finds particularly utility when used in an integrated partial oxidation gasification and vitrification system used for recovering the energy value from the organic portions of heterogeneous feedstocks while converting the inorganic portions to a safe and useable form.

BACKGROUND OF THE INVENTION

U.S. patent application Ser. No: 11/432,826, filed May 12, 2006 and entitled "COMBINED GASIFICATION AND VITRIFICATION SYSTEM" (hereafter the "combined system" and incorporated in its entirety herein by this reference) disclosed an improved method for processing organic and heterogeneous feedstocks. The description of the combined system describes a system that is capable of treating mixtures of inorganic materials, biomass, and fossil-based organic materials and their derivatives, including waste derived from the production and use of such fossil-based organic materials, and converting them into a clean fuel gas and an environmentally stable glass. The combined system consists generally of a gasification unit which converts all or a portion of the organic components of waste to a hydrogen rich gas and ash in communication with a joule heated vitrification unit which converts inorganic materials and ash formed in the gasification unit into glass, and may further include a plasma which converts carbon and products of incomplete gasification formed in the gasification unit into a hydrogen rich gas.

As described in the combined system, organic or heterogeneous mixtures of organic and inorganic feed stocks are first fed into the gasification unit where all or part of the organic portion of the feed stock are gasified. To assist in gasification, the materials are mixed with oxygen in the gasification unit using oxygen, air, carbon dioxide, oxygen enriched air, steam, and combinations thereof.

Within the partial oxidation gasification system, all or part of the organic portion of the feed stock is gasified. The effluent from the gasification process includes a gaseous portion, principally made up of carbon monoxide, hydrogen, and light hydrocarbon gasses, together with a solid and liquid portion, which includes unreacted and partially reacted organic materials such as carbon char, together with the inorganic portion of the feed stock, which may also include ash from the gasification process.

The effluent is then fed directly from the gasification system into a joule heated plasma reaction chamber to pyrolize and gasify the remaining solid and liquid organic materials, and to allow sufficient residence time and mixing to form the ash and other remaining inorganic portions of the feed stock into stable, vitrified glass.

The combined system further includes a feedback control device which measured effluent gasses, the flow rates of the feedstock, and the flow rates of the oxidant. Using that information, the feedback control device determines whether complete combustion was occurring in the gasification unit. Having recognized an undesirable operation, the feedback control device could then change the feed rates for one or both of the oxidant or the feedstock, thereby preventing complete combustion in the gasification unit.

For example, if the gasification unit is configured as a downdraft gassifier, the feedback control device could control a means for transporting organic material down the axial length of the downdraft gasifier. In this manner, the flow rate of the feedstock through the gassifier could be increased or decreased. The combined system disclosed several means for transporting organic material down the axial length of a downdraft gasifier and into the vitrification system including, but not be limited to, an auger, a rake, an agitating grate, one or more rotating drums, a piston, and combinations thereof.

While the agitating grate described in the combined system generally accomplishes the purposes of the combined system, the present invention overcomes drawbacks discovered when using an agitating grate as described in the combined system. Nevertheless, the present invention should not be limited to use in the combined system. Rather, the present invention is broadly applicable in any high temperature system where there is a desire to transfer solid materials at a controlled rate from one chamber to another. Accepting that caveat, and not meant to be limiting, it is useful for illustrative purposes to describe the advantages of the present invention in terms of some of the drawbacks of the agitating grate used in the combined system to enhance an understanding and appreciation of the present invention.

One difficulty that the combined system was designed to overcome was the failure of prior art systems to effectively and efficiently process heterogeneous feed stocks. One aspect of these heterogeneous feed stocks related to the agitating grate interposed between the gasifier and the joule heated melter of the combined system is the tendency of certain materials to block or plug different parts of the grate. When that happens, the gas flow circumvents the blocked or plugged section of the grate, and flows to the unblocked or unplugged sections. This, in turn, causes more rapid oxidation of the materials in the unplugged sections, and slower oxidation of the plugged sections, further exacerbating the problem as the more oxidized portions are reduced in size and thus generally flow through the grate while the less oxidized portions are not reduced, and tend to add to the clogged area of the grate.

Accordingly, there is a need for an improved means by which materials processed in one chamber of a high temperature system may be transferred to a second chamber of the high temperature system.

SUMMARY OF THE INVENTION

It is therefore an object of the present invention to provide an improved method and apparatus by which materials processed in one chamber of a high temperature system may be transferred to a second chamber of the high temperature system. It is a further object of the present invention to provide an improved method and apparatus by which materials processed in one chamber of a high temperature system may be crushed and reduced in size, thereby facilitating the transfer of those materials to a second chamber of the high temperature system. It is a further object of the present invention to provide an active grate wherein materials processed in one chamber of a high temperature system may agitated, thereby facilitating the flow of those materials to a second chamber of the high temperature system at a controlled rate. It is a further object of the present invention to provide an active grate in a waste treatment system interposed between a gasification unit capable of converting all or a portion of the organic components of a feed stream to a hydrogen rich gas and ash and a joule heated vitrification unit capable of converting inorganic materials and ash formed in the gasification unit into glass, and which, while not meant to be limiting, may further include a plasma capable of converting carbon and products of incomplete gasification formed in the gasification unit into a hydrogen rich gas.

These and other objects of the present invention are an improved active grate consisting of at least two elongated rockers positioned parallel to one and another, each rocker having a lower surface and an upper surface. Preferably, but not meant to be limiting, the improved grate of the present invention consists of several rockers. Each of said rockers are configured to rotate back and forth about their longitudinal axis. As used herein, the term longitudinal means along the major (or long) axis of the rocker.

Each individual rocker is further configured to rotate in the opposite direction of the adjacent rockers. Preferably, but not meant to be limiting, the lower surface is curved and the upper surface is angled. In this manner, any pair of adjacent rockers alternately forms a void allowing material to pass through active grate when rotating in one direction into a first position, and closes the void when rotated in the opposite direction to a second position.

While it is preferred that the lower surface is curved and the upper surface is angled, and such an arrangement is shown for illustrative purposes in the preferred embodiment described herein to promote an understanding and appreciation of the present invention, those having ordinary skill in the art having the benefit of this disclosure will recognize that the same effect can be accomplished with alternative geometries of the rocker surfaces. For example, and not meant to be limiting, an acceptable alternative for the curved lower surface might have several adjacent flat surfaces that approximated a curve. Similarly, the top surface could simply be planer. Accordingly, all such alternative geometries for both the upper and lower surfaces, including without limitation all combinations of all such alternative geometries, are included in this disclosure, and should be considered as contemplated by and part of the present invention.

The active grate of the present invention provides an advantage over prior art grates because as they are rotated, any pair of rockers alternately displaces material away from the active grate and then forms a void in the area between the rockers. In this manner, any material on top of the active grate is agitated up and allowed to fall down toward a void, thereby dispersing any large pieces across the upper surface of the active grate, and thus facilitating the regular and even flow of material through the active grate. Further, when the rockers are rotated from the first position to the second position, closing the void between them, any material in between these rockers is crushed between the adjacent edges of the rockers, thereby crushing and reducing the size of any large pieces, thus allowing their passage through the voids. This also facilitates the regular and even flow of material through the active grate.

Preferably, but not meant to be limiting, the active grate of the present invention is used in a combined gasification/vitrification waste treatment system. These systems consist of a gasification unit capable of converting all or a portion of the organic components of a feed stream to a hydrogen rich gas and ash and a joule heated vitrification unit capable of converting inorganic materials and ash formed in the gasification unit into glass. Preferably, but not meant to be limiting, the vitrification unit may further have a plasma capable of converting carbon and products of incomplete gasification formed in the gasification unit into a hydrogen rich gas. When used in a combined gasification/vitrification waste treatment system, the active grate of the present invention can effectively control and regulate an even rate of flow of materials from the gasification unit to the vitrification unit.

In these and other waste treatment systems wherein the active grate of the present invention can be advantageously deployed, the temperatures can be very high. These high temperatures can put a significant stain on the rockers of the active grate. Accordingly, it is preferred that the rockers include a coolant loop through the longitudinal axis of the rockers. By flowing a coolant through the coolant loop of the rockers, they can be maintained at a temperature that reduces the wear and tear on the rockers. Preferable coolants include, but are not limited to water, steam, ethylene glycol, paraffinic based heat transfer fluids, silicone based heat transfer fluids, and hydrocarbon heat transfer fluids. Water or other of these coolant fluids may be provided as a liquid, mist in a carrier gas, or steam. In this manner, the cooling effects of the water can be realized without generating excessive pressure changes in the rockers.

BRIEF DESCRIPTION OF THE DRAWINGS

The following detailed description of the embodiments of the invention will be more readily understood when taken in conjunction with the following drawings, wherein.

DETAILED DESCRIPTION OF THE PREFERRED EMBODIMENTS

Figure 1:
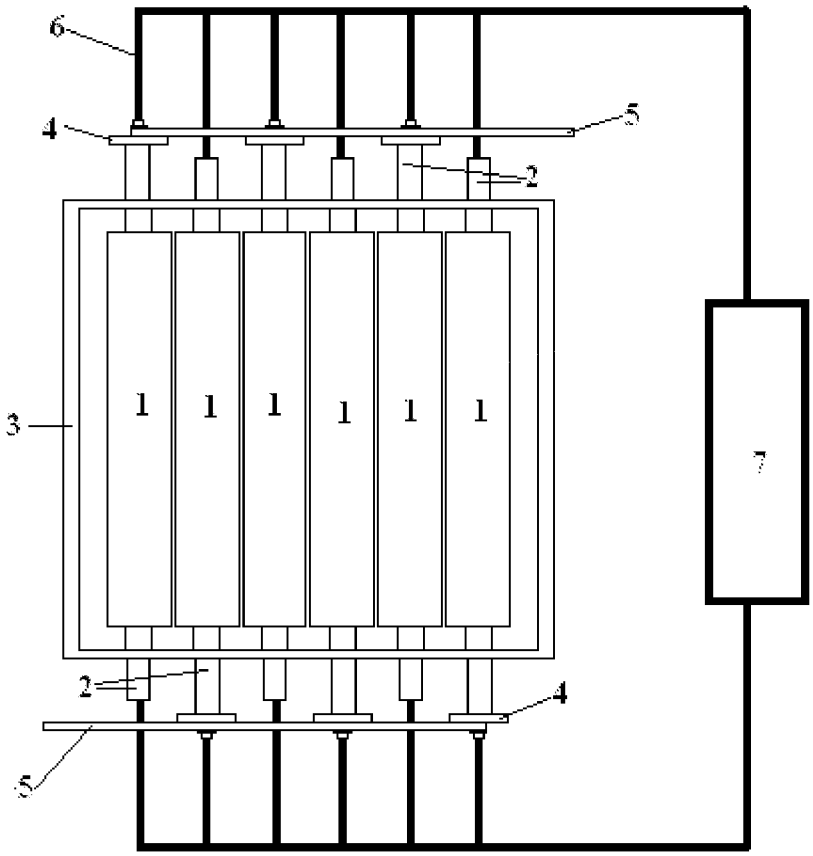
FIG. 1 is an overhead view of a preferred embodiment of the apparatus of the present invention.

For the purposes of promoting an understanding of the principles of the invention, reference will now be made to the embodiments illustrated in the drawings. Specific language will be used to describe the same, and like reference numbers will refer to like components of the invention. It will nevertheless be understood that no limitations of the inventive scope is thereby intended, as the scope of this invention should be evaluated with reference to the claims appended hereto. Alterations and further modifications in the illustrated devices, and such further applications of the principles of the invention as illustrated herein are contemplated as would normally occur to one skilled in the art to which the invention relates.

Figure 2:
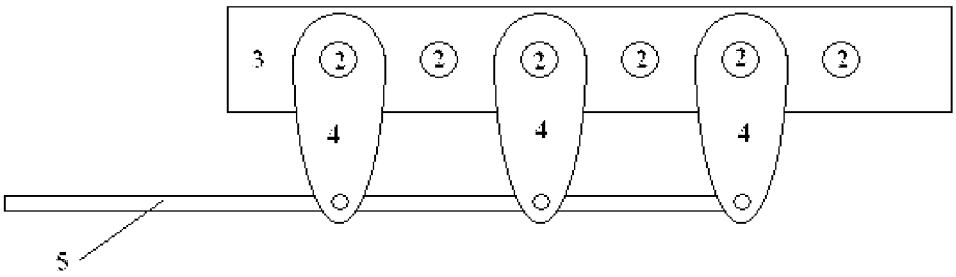
FIG. 2 is a side view of a preferred embodiment of the apparatus of the present invention.

For the purposes of promoting an understanding of the principles of the invention, FIG. 1 is an overhead view of a preferred embodiment of the active grate of the present invention and FIG. 2 is a side view of the same preferred embodiment of the active grate of the present invention. As shown in FIG. 1, a series of rockers 1 each having a center dowel 2 are arranged in a parallel fashion inside of a frame 3 such that center dowel 2 extends through frame 3 at each end. At one end of frame 3, alternating ends of every other center dowel 2 are attached to rocker arm 4 and rocker arms 4 are further attached to a shaker 5. In this arrangement, as shown in FIG. 2, by moving the shaker 5, alternating rocker arms 4 may be made to rotate about the center dowels 2 in unison with one and another.

A coolant loop 6 is connected through the longitudinal axis of the rockers 1 allowing a coolant to be flowed through the rockers 1 and thereby maintain the rockers at a suitable temperature for operation. A heat sink and pump 7 are further integral to coolant loop 6, and are used to facilitate the circulation of coolant through the rockers, and the removal of heat from the coolant and thus the coolant loop 6 and the rockers 1. The heat sink can be of any type known to those having skill in the art, including without limitation, a radiator or a heat exchanger.

At the other end of the frame 3, alternating ends of the remaining center dowels 2 are attached to rocker arms 4 and rocker arms 4 are further attached to shaker 5. In this arrangement, by moving shakers 5 in a coordinated fashion, adjacent alternating rocker arms 4 may be made to rotate about the center dowels 2 in a direction opposite to the adjacent rockers 1.

Figure 3:
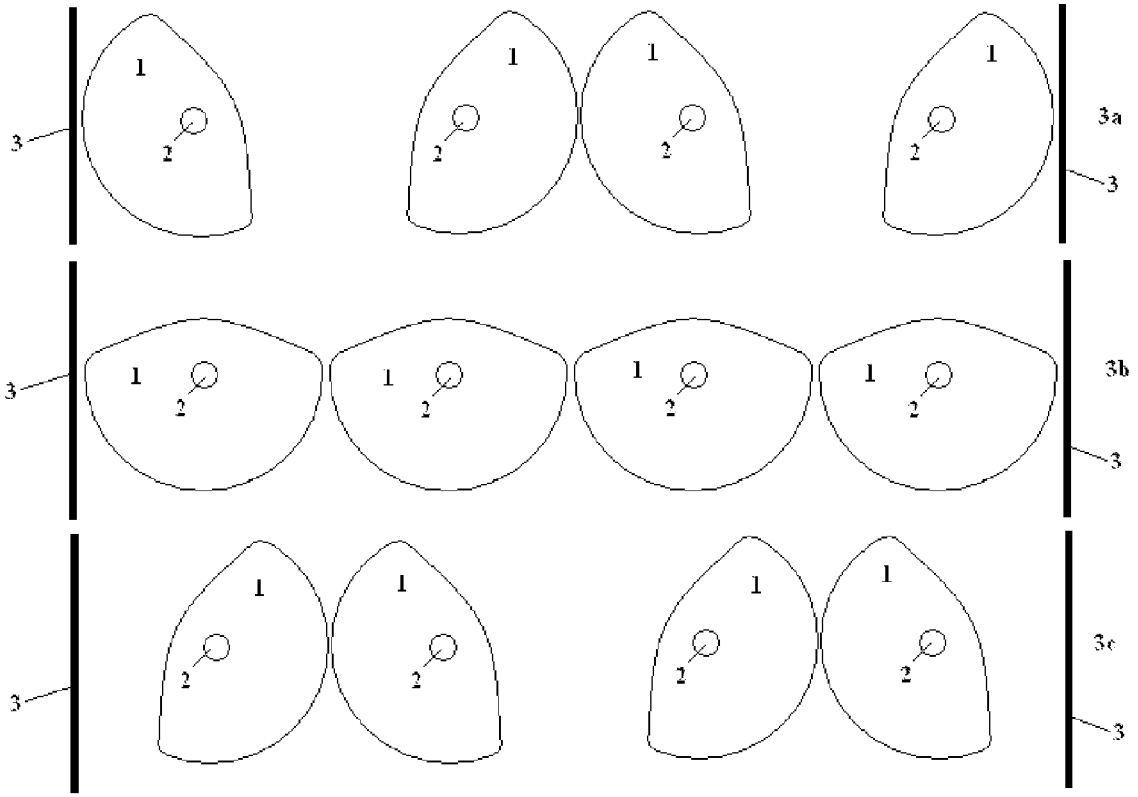
FIG. 3*a* is a cut away schematic view of a preferred embodiment of the apparatus of the present invention showing the position of the rockers in a first position.
FIG. 3*b* is a cut away schematic view of a preferred embodiment of the apparatus of the present invention showing the position of the rockers in a in a second position.
FIG. 3*c* is a cut away schematic view of a preferred embodiment of the apparatus of the present invention showing the position of the rockers in a in an intermediate position.

FIG. 3 is a cut away schematic view of a preferred embodiment of the apparatus of the present invention showing how the adjacent pairs of rockers interact as they are rotated about a central axis, and, while not meant to be limiting, a preferred shape of the rockers 1 across their longitudinal axis. FIG. 3*a* shows the position of the rockers 1 in a first position. As shown in FIG. 3*a*, in between alternating pairs of adjacent rocker arms 1 a void is formed in a first position allowing material to pass through the active grate. When the shakers 5 (as shown in FIGS. 1 and 2) are moved at each end of the active grate in opposite directions, each of the rockers 1 are caused to rotate in a direction opposite to any adjacent rockers 1. As shown in FIG. 3*b*, the voids close in a second position, and as shown in FIG. 3*c*, another void is formed in a third position.

Comparing FIGS. 3*a* and 3*c*, it should be noted that the adjacent pairs of rockers 1 will alternatively form a void and then act to displace material placed on the rockers 1 in an upward direction. It should further be noted that as rockers 1 are rotated from a first position to a second position, any material caught in the void in between rockers 1 will be crushed by the rotation of the rockers. In this manner, materials on top of the grate that might otherwise tend to block the grate, or to block portions of the grate, are made to pass through the grate by agitating those materials, and by crushing and reducing the size of those materials.

Figure 4:
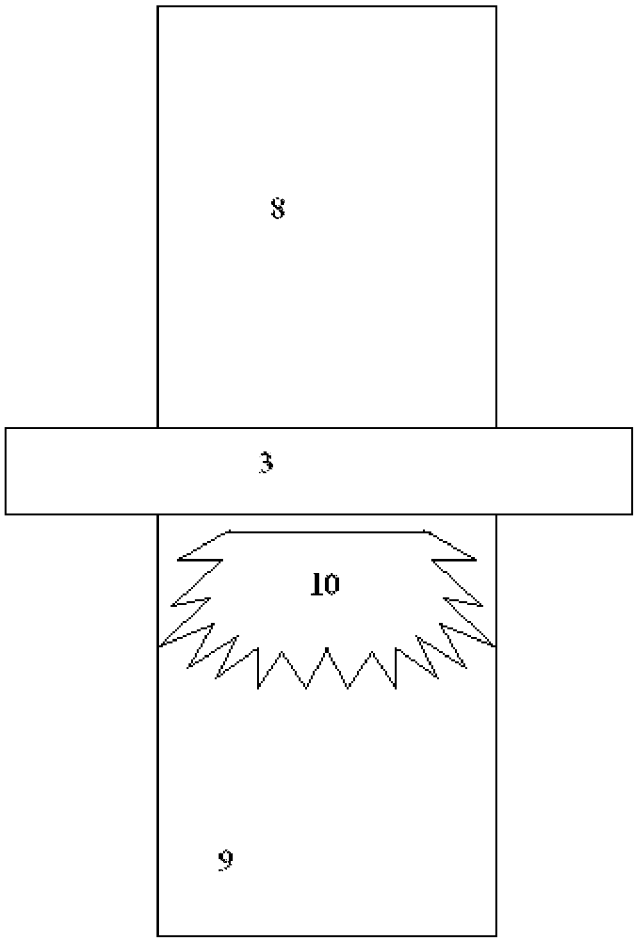
FIG. 4 is a schematic view of a preferred embodiment of the apparatus of the present invention used in conjunction with a combined system.

FIG. 4 is a schematic view of a preferred embodiment of the apparatus of the present invention used in conjunction with a combined system. As shown in FIG. 4, a waste treatment system consisting of a gasification unit 8 capable of converting all or a portion of the organic components of a feed stream to a hydrogen rich gas and ash is attached to the frame 3 of the improved active grate of the present invention. A feed stream of materials are fed into the gasification unit 8 where all or a portion of the organic components are converted to a hydrogen rich gas and ash. This ash and any other solids are then passed through the improved active grate of the present invention to a joule heated vitrification unit 9. This joule heated vitrification unit 9 is capable of converting inorganic materials and ash formed in the gasification unit into glass, and further contains a plasma 10 capable of converting carbon and products of incomplete gasification formed in the gasification unit into a hydrogen rich gas.

While this particular configuration is preferred, the present invention should in no way be limited to this configuration, and it should be understood that this configuration was selected merely for illustrative purposes.

While the invention has been illustrated and descried in detail in the drawings and foregoing description, the same is to be considered as illustrative and not restrictive in character. Only certain embodiments have been shown and described, and all changes, equivalents, and modifications that come within the spirit of the invention described herein are desired to be protected. Any experiments, experimental examples, or experimental results provided herein are intended to be illustrative of the present invention and should not be considered limiting or restrictive with regard to the invention scope. Further, any theory, mechanism of operation, proof, or finding stated herein is meant to further enhance understanding of the present invention and is not intended to limit the present invention in any way to such theory, mechanism of operation, proof, or finding.

Thus, the specifics of this description and the attached drawings should not be interpreted to limit the scope of this invention to the specifics thereof. Rather, the scope of this invention should be evaluated with reference to the claims appended hereto. In reading the claims it is intended that when words such as "a", "an", "at least one", and "at least a portion" are used there is no intention to limit the claims to only one item unless specifically stated to the contrary in the claims. Further, when the language "at least a portion" and/or "a portion" is used, the claims may include a portion and/or the entire items unless specifically stated to the contrary. Finally, all publications, patents, and patent applications cited in this specification are herein incorporated by reference to the extent not inconsistent with the present disclosure as if each were specifically and individually indicated to be incorporated by reference and set forth in its entirety herein.

The invention claimed is:

1. An active grate comprising at least two elongated rockers positioned parallel to one another, each rocker having a lower surface and an upper surface, each of said rockers further configured to rotate about their longitudinal axes to form a void allowing material to pass through said active grate when at least one of said rockers is in a first position and to close said void when two adjacent rockers are in a second position.

2. The active grate of claim 1, wherein at least one pair of rockers is operable to displace the material away from said active grate in said first position.

3. The active grate of claim 1, wherein at least one pair of rockers is operable to provide a crushing force on the material when rotated between said first and second positions.

4. The active grate of claim 1 further comprising a coolant loop configured to flow coolant through at least one of the rockers.

5. The active grate of claim 1, wherein the coolant is selected from water, steam, ethylene glycol, paraffinic based heat transfer fluids, silicon based heat transfer fluids, hydrocarbon heat transfer fluids, or combinations thereof.

6. The active grate of claim 1, wherein the upper surface of each rocker is planar.

7. A system comprising:

a gasification unit for at least partially converting organic components of a feed stream to a hydrogen rich gas and ash;

a joule heated vitrification unit downstream from the gasification unit and configured to convert inorganic materials and ash into glass, the vitrification unit having a plasma for converting carbon and products of incomplete gasification into hydrogen rich gas; and an active grate disposed between said gasification unit and the vitrification unit, the grate comprising a rocker positioned parallel to an adjacent rocker, each rocker having a lower surface and an upper surface, wherein said rocker is configured to rotate about a longitudinal axis of said rocker to a first position to form a void to allow material to pass from the gasification unit to the vitrification unit through said active grate, said rocker further configured to rotate to a second position to close said void.

8. The system of claim 7 wherein said adjacent rocker is configured to rotate in a direction opposite said rocker.

9. The system of claim 7 wherein said rocker further comprises a coolant loop for flowing a coolant therethrough.

* * * * *